US010696051B1

(12) United States Patent
Ferrara, Jr. et al.

(10) Patent No.: US 10,696,051 B1
(45) Date of Patent: Jun. 30, 2020

(54) MULTIPLE SACRIFICIAL SHEETS STEERING DEVICE FOR FULL WIDTH INKJET PRINTHEAD JETTING

(71) Applicant: Xerox Corporation, Norwalk, CT (US)

(72) Inventors: Joseph M. Ferrara, Jr., Webster, NY (US); Carlos M. Terrero, Ontario, NY (US); Roberto A. Irizarry, Rochester, NY (US); Jacob R. McCarthy, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/357,967

(22) Filed: Mar. 19, 2019

(51) Int. Cl.

| | |
|---|---|
| ***B41J 2/165*** | (2006.01) |
| ***B41J 2/155*** | (2006.01) |
| ***B41J 13/00*** | (2006.01) |
| ***B41J 11/00*** | (2006.01) |

(52) U.S. Cl.
CPC ..... *B41J 2/16526* (2013.01); *B41J 2/155* (2013.01); *B41J 2/16585* (2013.01); *B41J 11/0055* (2013.01); *B41J 13/0018* (2013.01); *B41J 2002/1657* (2013.01); *B41J 2002/16529* (2013.01); *B41J 2002/16591* (2013.01)

(58) Field of Classification Search
CPC ..... B41J 2/155; B41J 2/16585; B41J 2002/16529
See application file for complete search history.

(56) References Cited

U.S. PATENT DOCUMENTS

| | | | |
|---|---|---|---|
| 5,659,342 | A | 8/1997 | Lund et al. |
| 5,774,142 | A | 6/1998 | Nguyen et al. |
| 5,805,182 | A | 9/1998 | Lee |
| 6,523,932 | B2 | 2/2003 | Johnson |
| 6,616,266 | B2 | 9/2003 | Neal et al. |
| 6,644,772 | B2 | 11/2003 | Choi |
| 9,533,491 | B1 | 1/2017 | LeFevre et al. |
| 2011/0157270 | A1* | 6/2011 | Kawakami ..... B41J 2/16526 347/16 |
| 2017/0210125 | A1 | 7/2017 | Garcia Alvarez et al. |

* cited by examiner

*Primary Examiner* — Julian D Huffman
(74) *Attorney, Agent, or Firm* — Gibb & Riley, LLC

(57) ABSTRACT

Devices and processes include/use an inkjet printhead, a sheet transport positioned to move sheets of media past the inkjet printhead, a sheet registration device positioned to align the sheets of media, and a controller electrically connected to the inkjet printhead and the sheet registration device. The controller is adapted to periodically control the sheet registration device to align a first sacrificial sheet with a first edge of the sheet transport and align a second sacrificial sheet with a second edge of the sheet transport and that is opposite the first edge. The controller is adapted to control the inkjet printhead to eject ink from a first set of nozzles to the first sacrificial sheet and eject ink from a second set of nozzles to the second sacrificial sheet. The first set of nozzles contains different nozzles from the second set of nozzles.

20 Claims, 16 Drawing Sheets

MULTIPLE SACRIFICIAL SHEETS STEERING DEVICE FOR FULL WIDTH INKJET PRINTHEAD JETTING

BACKGROUND

Systems and methods herein generally relate to inkjet printers and more particularly to devices and processes that steer sheets and perform jetting of printheads.

On aqueous inkjet printers, various sheet sizes are used for printing jobs. A maximum print zone exists, as limited by the physical footprint of the inkjet printheads. For example, when one is printing legal size documents, long edge feed, with a relatively full image, all jets on the inkjet printheads (e.g., the maximum print zone) could be used. However, if one uses a smaller size sheet or uses a short edge feed, there could be jets that will not experience any ink movement for a particularly long time, and this is dependent on the length of the job being printed.

As a result, unused jets can develop a viscous fluid that blocks the jets, causing missing jets if the next job requires these previously unused jets. Thus, nozzles of inkjet printheads routinely clog when such are unused for extended periods, for example when certain colors or nozzles go unused for an extended period.

This can result in nozzles that do not eject any ink, or that only eject a significantly reduced drop mass, which causes less than optimal pixel placement ("streaky" solid-fill images) and lower than target drop mass (lighter than target solid-densities). To mitigate, users often run print head maintenance processes that jet ink from the heads. However, print head maintenance processes can be a waste of consumables, as well as a productivity detractor.

If the clogged nozzle condition goes uncorrected, it can lead to intermittent firing and the jet can eventually cease firing, and such a situation can be unrecoverable resulting in irreversible printhead damage. Therefore, maintaining clog free printheads provides greater longevity to the inkjet printheads. Depending on the pre-condition of the head, the time scale for onset of such unrecoverable failure could range from a few hours to days.

Additionally, certain colors (e.g., magenta, etc.) are more susceptible to clogging relative to other colors, because certain color inks dry faster than other color inks, which causes the ink to dry in the nozzles of the inkjet printhead during extended inactivity. Such nozzle clogging issues can be mitigated, but not avoided, by jetting and cleaning cycles.

SUMMARY

Exemplary devices herein include (among other components) an inkjet printhead, a sheet transport adapted and positioned to move sheets of media past the inkjet printhead, a sheet registration device (which can include a first sheet registration device specifically adapted to align the sheets of media relative to edges of the sheet transport and a second sheet registration device specifically adapted to align the sheets of media relative to the inkjet printhead), and a controller electrically connected to the inkjet printhead and the sheet registration device(s).

The controller is adapted to periodically activate the sheet registration device(s) to align one edge of a first sacrificial sheet with a "first" edge of the sheet transport and align one edge of a second sacrificial sheet with a "second" edge of the sheet transport and that is opposite the first edge. The first sacrificial sheet can immediately follow the first sacrificial sheet on the sheet transport.

Also, the controller is adapted to control the inkjet printhead to eject ink from a first set of nozzles to the first sacrificial sheet and eject ink from a second set of nozzles to the second sacrificial sheet, where the first set of nozzles contains different nozzles from the second set of nozzles. Here, nozzles of the first set of nozzles are relatively closest to the first edge of the sheet transport, and nozzles of the second set of nozzles are relatively closest to the second edge of the sheet transport.

The controller is further adapted to control the second sheet registration device to align a third sacrificial sheet in a location along the sheet transport that is between the first sacrificial sheet and the second sacrificial sheet and that immediately follows the first sacrificial sheet and the second sacrificial sheet.

The inkjet printhead can include multiple printheads, such as a first printhead and a second printhead. With such, the first set of nozzles are within the first printhead and the second set of nozzles are within the second printhead. Also, the inkjet printhead is located adjacent to the sheet transport in a position such that all nozzles of the inkjet printhead are positioned adjacent to an area of the sheet transport that is between the first edge and the second edge of the sheet transport.

Additionally, the controller can be adapted to control the inkjet printhead to eject ink to the first sacrificial sheet and the second sacrificial sheet periodically from all nozzles or only from selected nozzles that have not ejected ink for more than a non-used time limit.

Exemplary methods herein control the sheet transport to move sheets of media past an inkjet printhead. These methods periodically control the sheet registration device(s) to align the first sacrificial sheet with the first edge of the sheet transport and align the second sacrificial sheet with the second edge of the sheet transport. With the process of controlling the sheet registration device, the first sacrificial sheet immediately follows the first sacrificial sheet on the sheet transport. Additionally, the sheet registration device can be controlled to align a third sacrificial sheet in a location along the sheet transport that is between the first sacrificial sheet and the second sacrificial sheet and that immediately follows the first sacrificial sheet and the second sacrificial sheet.

Also, these methods can control the inkjet printhead to eject ink from a first set of nozzles to the first sacrificial sheet and eject ink from a second set of nozzles to the second sacrificial sheet. Again, the first set of nozzles contains different nozzles from the second set of nozzles. Additionally, the process of controlling the inkjet printhead to eject ink can include controlling the inkjet printhead to eject ink from a third set of nozzles to the third sacrificial sheet, where the third set of nozzles contains different nozzles from the first set of nozzles and the second set of nozzles. Alternatively, the process of controlling the inkjet printhead to eject ink can include controlling the inkjet printhead to eject ink from the first set of nozzles and the second set of nozzles to the third sacrificial sheet.

The process of controlling the inkjet printhead to eject ink can control the inkjet printhead to eject ink to the first sacrificial sheet and the second sacrificial sheet from all nozzles or only from nozzles that have not ejected ink for more than a non-used time limit.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
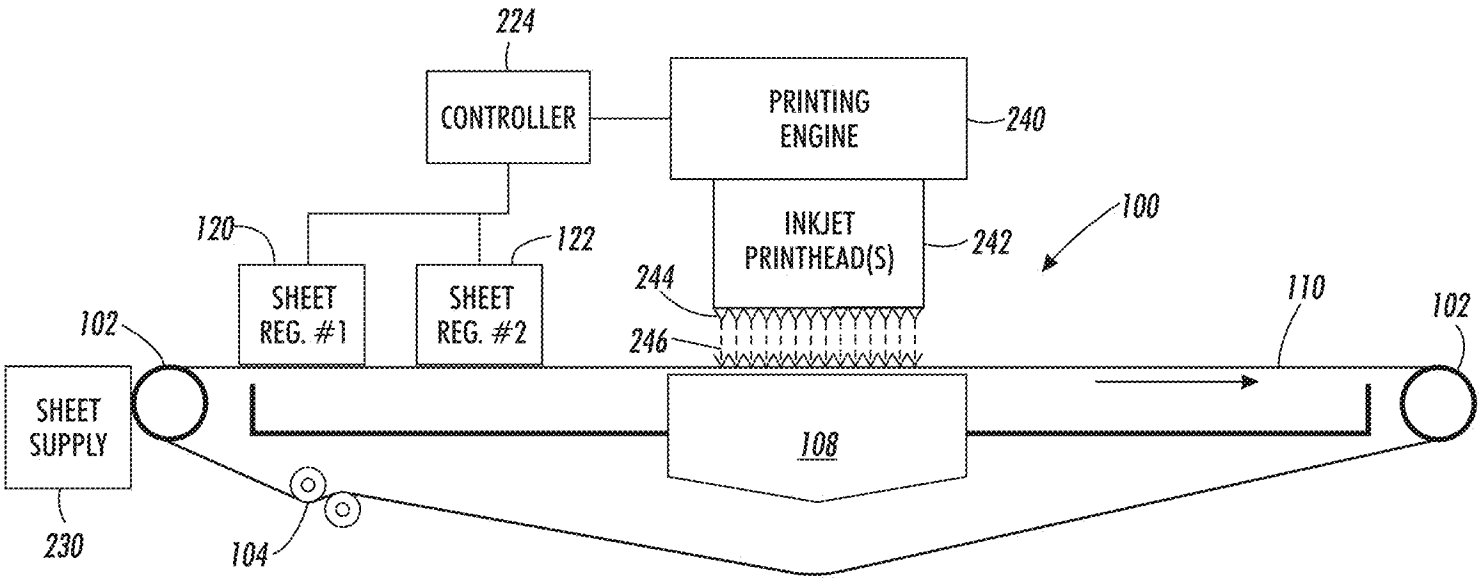
FIG. 1 is a cross-sectional conceptual diagrams illustrating inkjet printing structures herein.

As mentioned above, nozzles of inkjet printheads routinely clog when such are unused for extended periods, such as when paper sizes or printing patterns do not regularly utilize all jets/nozzles in the maximum print zone. Jetting (maintenance ejecting of ink) along the maximum print zone can be accomplished, for example, by using an elongated sheet (e.g., legal size paper) with the longest dimension oriented perpendicular to the processing direction (in the cross-processing orientation) to allow all nozzles in the maximum print zone to be jetted onto the cross-processing oriented legal-size sheet. However, if one does not regularly print on elongated sheets, this could require users to unnecessarily devote a paper tray in the feeder solely to longer sheets, which may be inconvenient or uneconomical, especially if the user never prints on that size sheet.

In view of this, devices and processes herein steer multiple sacrificial sheets to different belt edges to provide full width inkjet printhead jetting, without requiring dedicated oversized sacrificial sheets. Therefore, the devices and processes herein provide dual edge registration to avoid drying out aqueous inkjet printhead nozzles when jobs do not use the maximum print zone. This allows users to perform jetting of the maximum print zone using any size sheet, thereby avoiding dedication of a print tray to elongated sheets that are not otherwise utilized. In other words, even if a user almost always prints on smaller sheets, the devices and methods herein provide a user with the option to utilize such smaller sheets to perform jetting of all nozzles within all printheads, which allows the user to maintain just the actual size media that they regularly use for printing operations (print jobs) within the print trays.

In one example, if one prints a relatively narrow image (e.g., 11" wide), certain jets closer to one or more of the belt edges may not be used, and the liquid ink within such jets will dry, requiring jetting or even more cleaning when switching to a full width job (e.g., 14"). The devices and processes herein alternate alignment of sacrificial sheets to opposing edges on the transport utilizing, for example, cross rollers/nips and other registration devices to address this issue. When the previous sheet is out of the nip, the nip will disengage, allowing the immediately next sheet to be steered to the opposing edge. Numerous nips may be used to accommodate different paper sizes, as well as to provide more vigorous steering.

Further, the cross rollers may be part of a dedicated registration device that only engages when the sheet is being registered to the appropriate edge in preparation of a maximum print zone jet. The dedicated registration device can be placed prior to a conventional registration nip that performs an alignment of the sheets with respect to the inkjet printhead (ensuring that the printing occurs at the correct location on the sheets). Thus, the dedicated registration device may only engage when the oppositely edge registered sheets are need.

Also, this jetting can be controlled to occur for all nozzles at specific sheet counts (e.g., after every N sheets) or only for nozzles that have not ejected ink for longer than a non-use time limit. This non-use time limit can be different intervals for different type inks or different ink colors. Therefore, with devices and methods herein, nozzles within the inkjet printheads can be selectively jetted only after an idle time period (during which the nozzles do not eject the liquid ink) or sheet count has expired. Such can also be different on a nozzle-by-nozzle basis depending upon which nozzles were used or not used in recent print job operations (where, in print job operations, the ink is printed on print media in a pattern according to a print job to produce an item of printer output, which is contrasted with jetting on sacrificial sheets that are discarded after printing).

As shown, for example, in FIGS. 1 and 7, devices herein can be printing apparatuses that can include, among other components (as shown in FIG. 1) a media supply 230 storing print media, a media path 100 having a vacuum belt 110 with perforations between the belt edges, and a vacuum manifold 108 positioned adjacent (below) the vacuum belt 110 in a location to draw air through the perforations or openings. As shown in FIG. 1, the vacuum belt 110 is supported between rollers 102, at least one of which is driven, and the belt is kept under proper tension using tensioning rollers 104.

The generic media supply 230 shown in the drawings can include various elements such as a paper tray, feeder belts, alignment guides, etc., and such devices can store cut sheets, and transport the cut sheets of print media to the vacuum belt 110. Also, a print engine 240 is positioned adjacent the vacuum belt 110 in a location to receive sheets from the vacuum belt 110 to allow nozzles 244 in one or more printheads 242 to eject ink 246 on sheets of print media. Additionally, various sheet registration devices 120, 122 are included to align the sheets of media before they reach the inkjet printheads 242. A processor/controller 224 is electrically connected to the printing engine 240, inkjet printheads 242, sheet registration devices 120, 122 etc.

The side of the vacuum belt 110 where the manifold 108 is located is arbitrarily referred to herein as the "bottom" of the vacuum belt 110, or the area "below" the vacuum belt 110. Conversely, the side of the vacuum belt 110 where the inkjet printheads 242 are located is arbitrarily referred to herein as the "top" of the vacuum belt 110, or the area "above" the vacuum belt 110. However, despite these arbitrary designations, the device itself can have any orientation that is useful for its intended purpose. As shown in FIG. 1, the vacuum belt 110 is positioned adjacent the media supply 230 in a location to move the sheets of the print media from the media supply 230.

Figure 2:
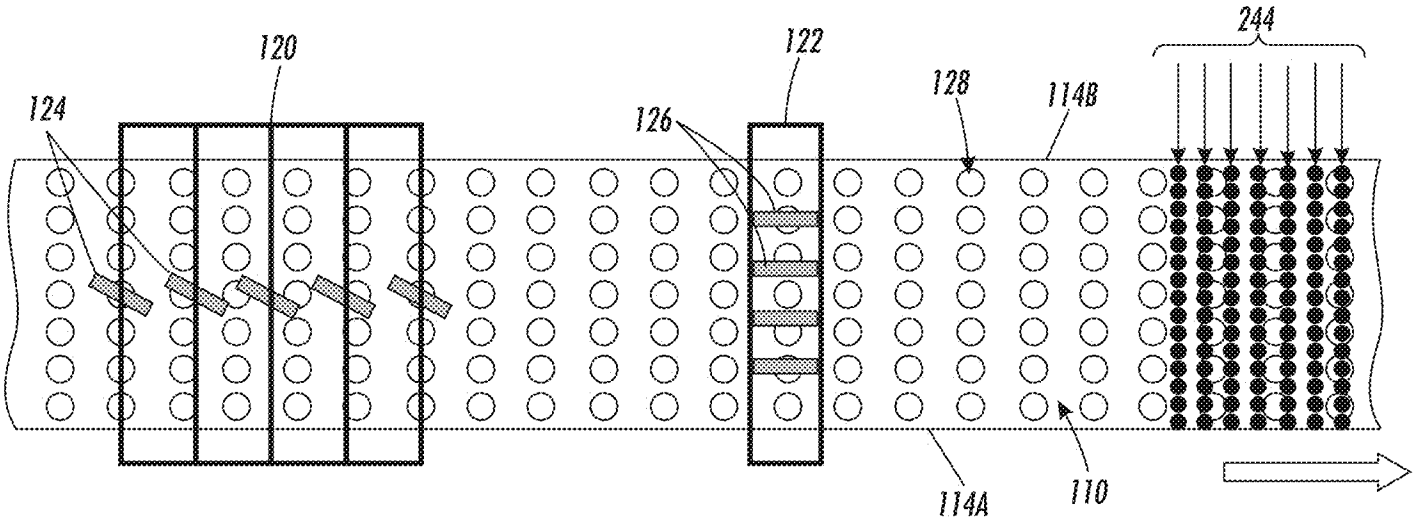
FIGS. 2-6 are top-view conceptual diagrams illustrating inkjet printing structures herein.

While FIG. 1 shows a side view of the media path 100, FIG. 2 is a schematic diagram illustrating a top view (plan view) of the belt 110 that is rotated 90° relative to FIG. 1. FIG. 2 illustrates the holes/perforations that are openings 128 through the belt 110, the belt edges 114A, 114B and the processing direction (represented by a block arrow) which is the direction in which the belt 110 travels.

More specifically, FIG. 2 illustrates the top of the sheet transport 110 positioned to move sheets of media past the location of the nozzles 244, a sheet registration device (which can be a single integrated device or can be separate devices including a first sheet registration device 120 specifically adapted to align the sheets of media relative to edges 114A, 114B of the sheet transport 110 and a second sheet registration device 122 specifically adapted to align the sheets of media relative to the inkjet printhead 242). The use of separate registration devices reduces the complexity of each separate device and potentially performs the different alignment/registration functions more quickly or more effectively (e.g., more accurately, in a single operation, without side-effects such as unintended rotation, etc.). The relative positions of the first and second sheet registration devices 120, 122 could be switched, depending upon implementation. The controller 224 (FIG. 1) is electrically connected to the inkjet printhead 242, and the first and second sheet registration devices 120, 122 to permit control over such devices.

Figure 3A:
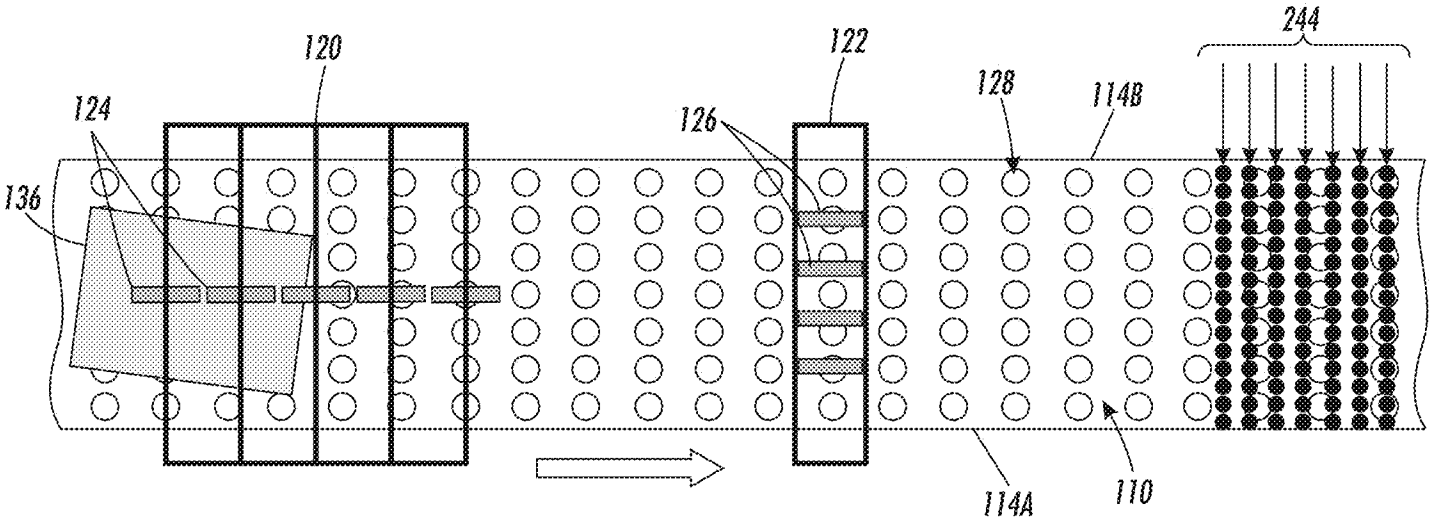
Figure 3B:
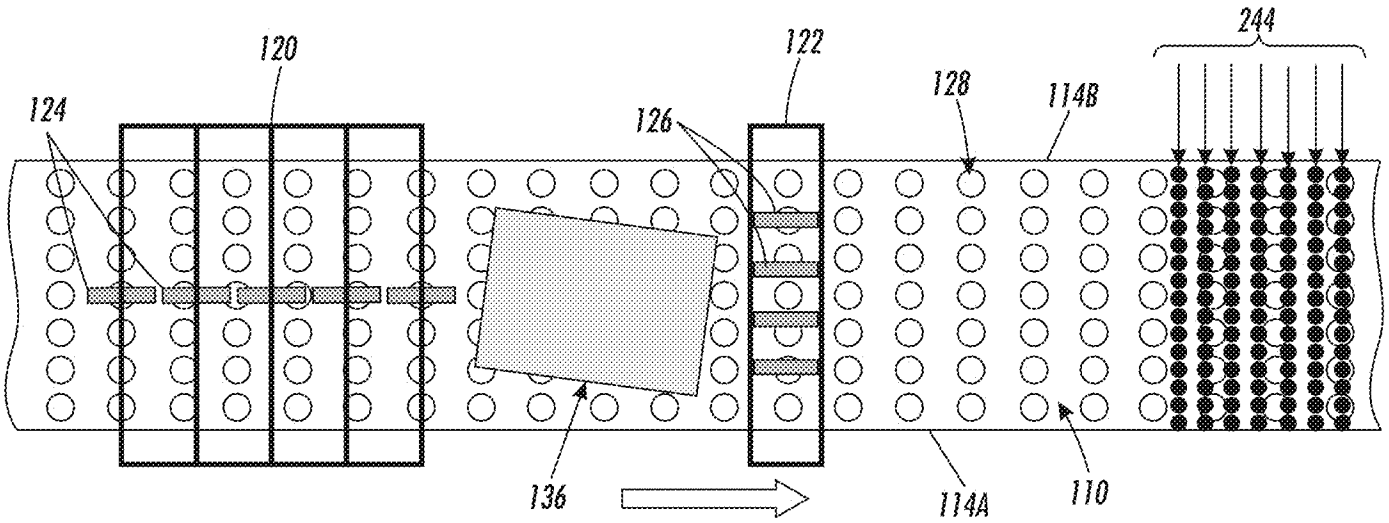

FIG. 3A illustrates a sheet of media 136 that is held on the top of the sheet transport 110 by the vacuum force exerted through the openings 128, and that is moved by the sheet transport 110 in the processing direction. As can be seen in FIG. 3A, the edges of the sheet of media 136 are not parallel to the edges 114A, 114B of the sheet transport 110 and this improper rotation or "skew" will be corrected by the second sheet registration device 122. Therefore, the nips/rollers 124 of the first sheet registration device 120 are all aligned in the processing direction to allow the sheet of media 136 to move without affecting skew (as shown in FIG. 3B).

Figure 3C:
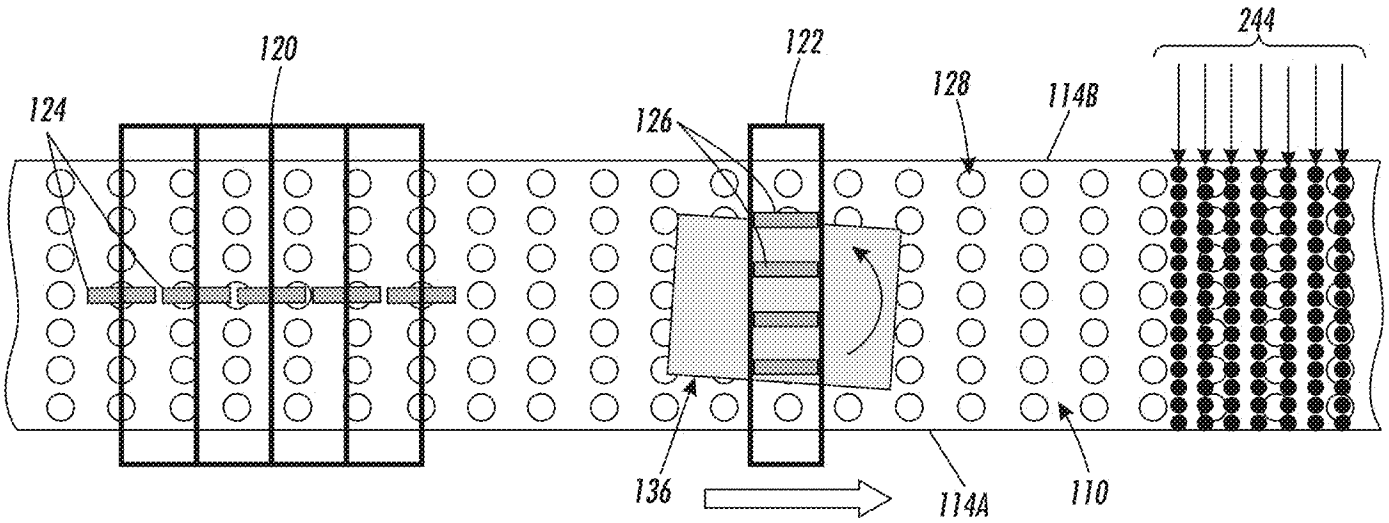
Figure 3D:
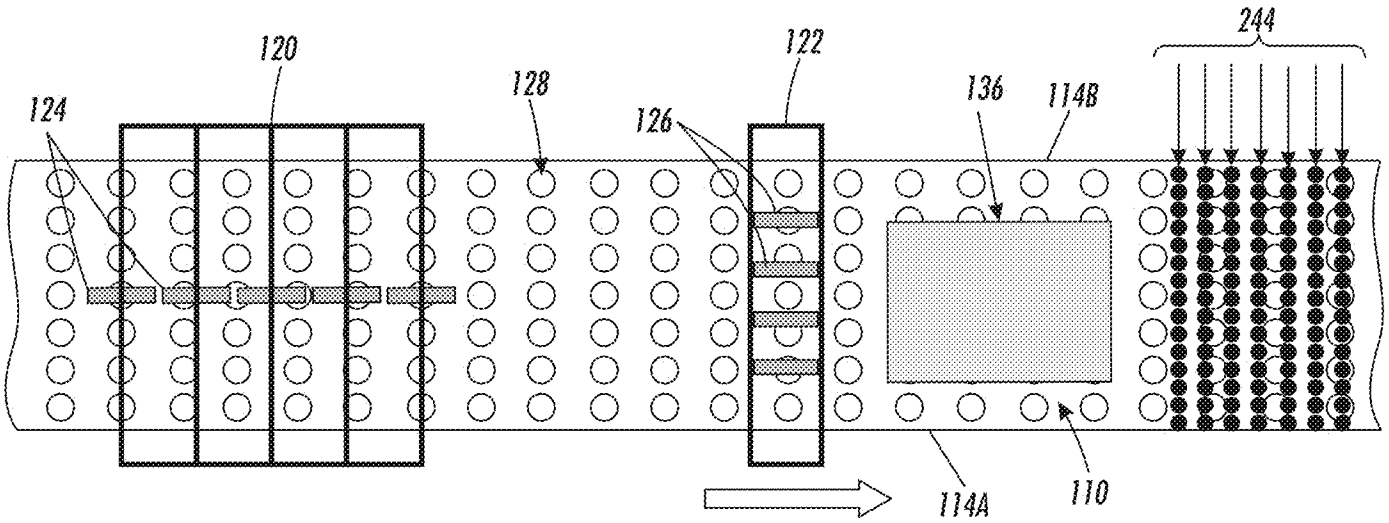

Next, as shown in FIG. 3C, the second sheet registration device 122 utilizes different speeds of the various rollers/nips 126 to rotate the sheet of media 136 (as controlled by the controller 224) to correct the skew (and make the edges of the sheet of media 136 parallel to the edges 114A, 114B of the sheet transport 110). As shown in FIG. 3D, this presents the sheet of media 136 to the nozzles 244 properly aligned with the edges 114A, 114B of the sheet transport 110 to allow items to be printed on the sheet of media 136 by ejecting ink 246 from the nozzles 244 in the correct locations on the sheet of media 136.

Figure 4A:
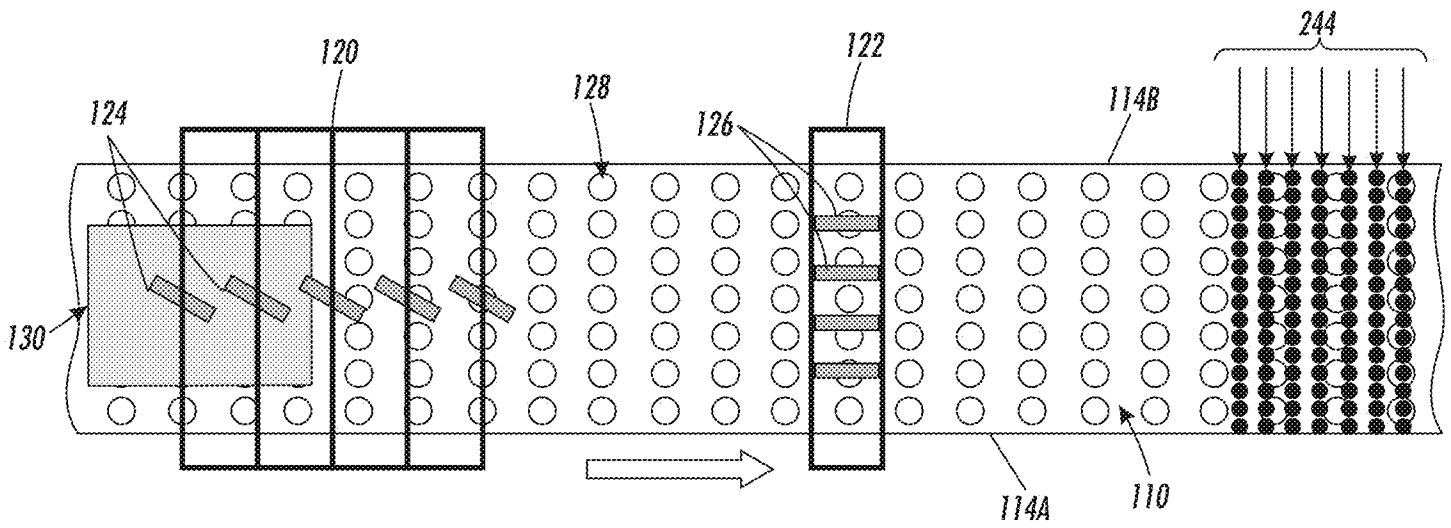
Figure 4B:
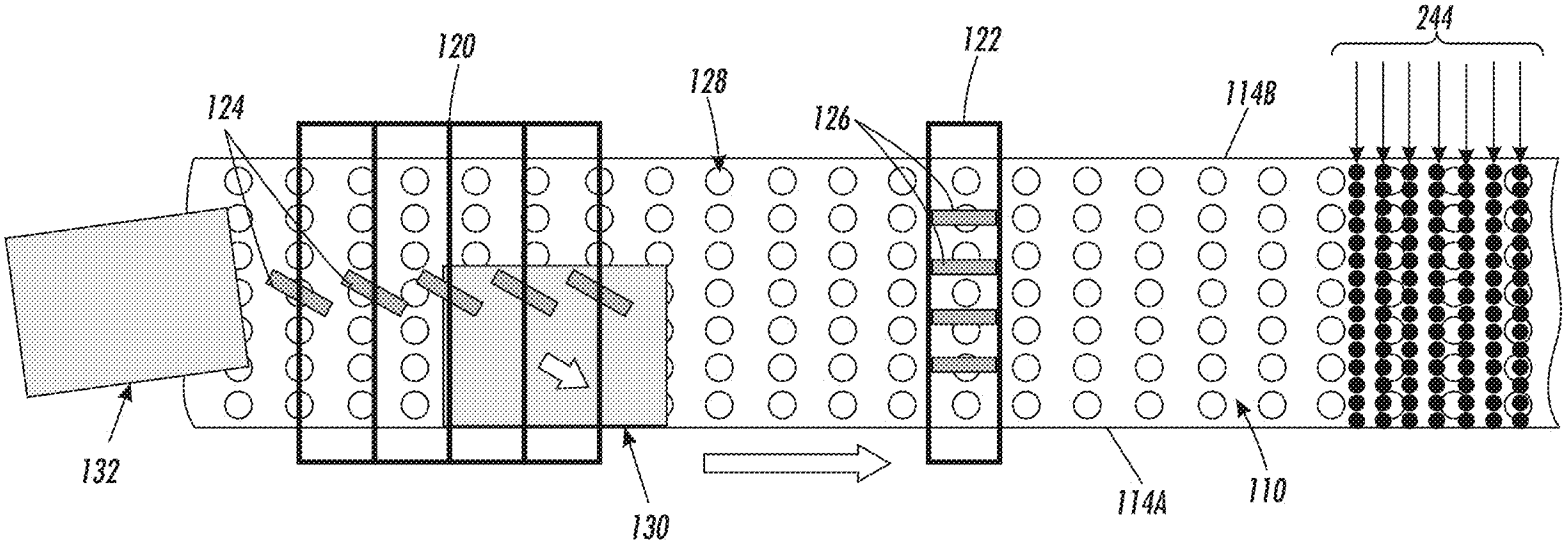

FIG. 4A illustrates a first sacrificial sheet 130 being fed into the first sheet registration device 120 by the sheet transport 110. The controller 224 is adapted to periodically activate the first sheet registration device 120 to align one edge of the first sacrificial sheet 130 with a "first" edge 114A of the sheet transport 110. This is shown in FIGS. 4A and 4B where the rollers 124 of the first registration device 120 are controlled by the controller 224 to be angled toward the first edge 114A of the sheet transport 110, which drives the first sacrificial sheet 130 toward the first edge 114A without rotating the first sacrificial sheet 130. As shown in FIG. 4B, this aligns one edge of the first sacrificial sheet 130 with the first edge 114A of the sheet transport 110.

Figure 4C:
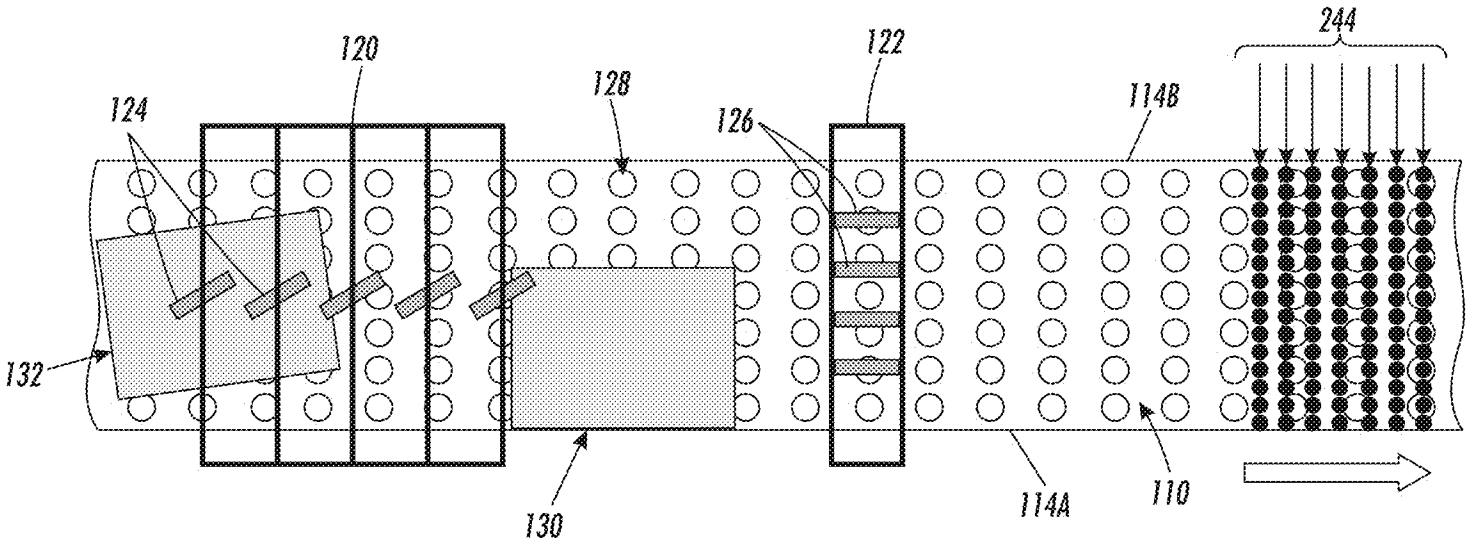

FIG. 4B also illustrates that a second sacrificial sheet 132 (that is skewed in this example to illustrate some features herein) immediately follows the first sacrificial sheet of media 130, without any intervening sheets of media between the first and second sacrificial sheets. As shown in FIG. 4C, the controller 224 is adapted to periodically activate the first sheet registration device 120 to align one edge of the second sacrificial sheet 132 with a "second" edge 114B of the sheet transport 110. Note that the second edge 114B is opposite the first edge 114A. This is shown in FIGS. 4C and 4D, where the rollers 124 of the first registration device 120 are angled toward the second edge 114B of the sheet transport 110 to drive the second sacrificial sheet 132 toward the second edge 114B without any rotation.

Figure 4D:
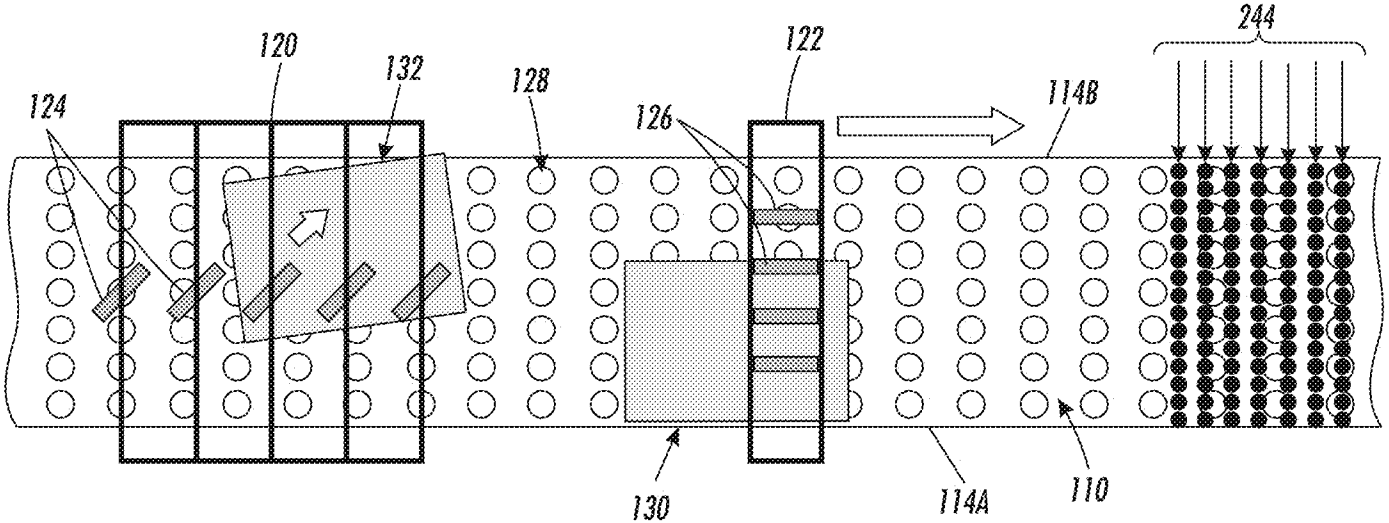

As shown in FIG. 4D, this aligns the second sacrificial sheet 132 with the second edge 114B of the sheet transport 110, but does not remove the skew initially present in the second sacrificial sheet 132. However, as shown in FIG. 4E, the second sheet registration device 122 rotates the second sacrificial sheet 132 to remove any skew and to fully align the edge of the second sacrificial sheet 132 with the second edge 114B of the sheet transport 110.

Figure 4E:
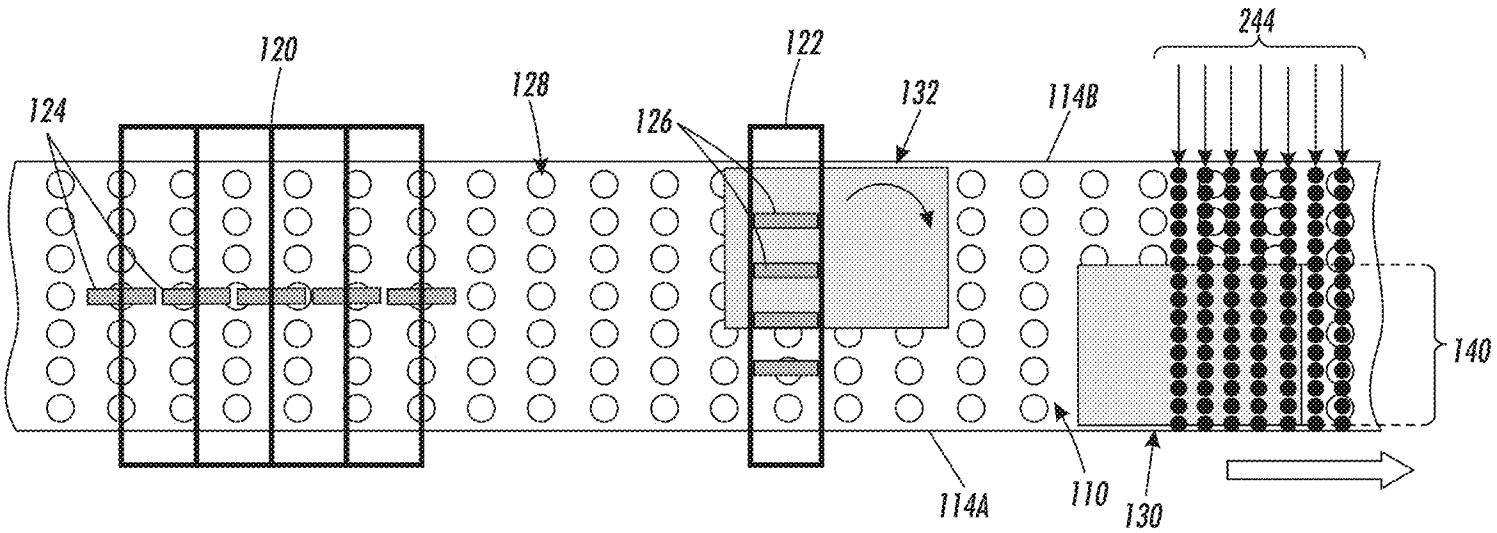
Figure 4F:
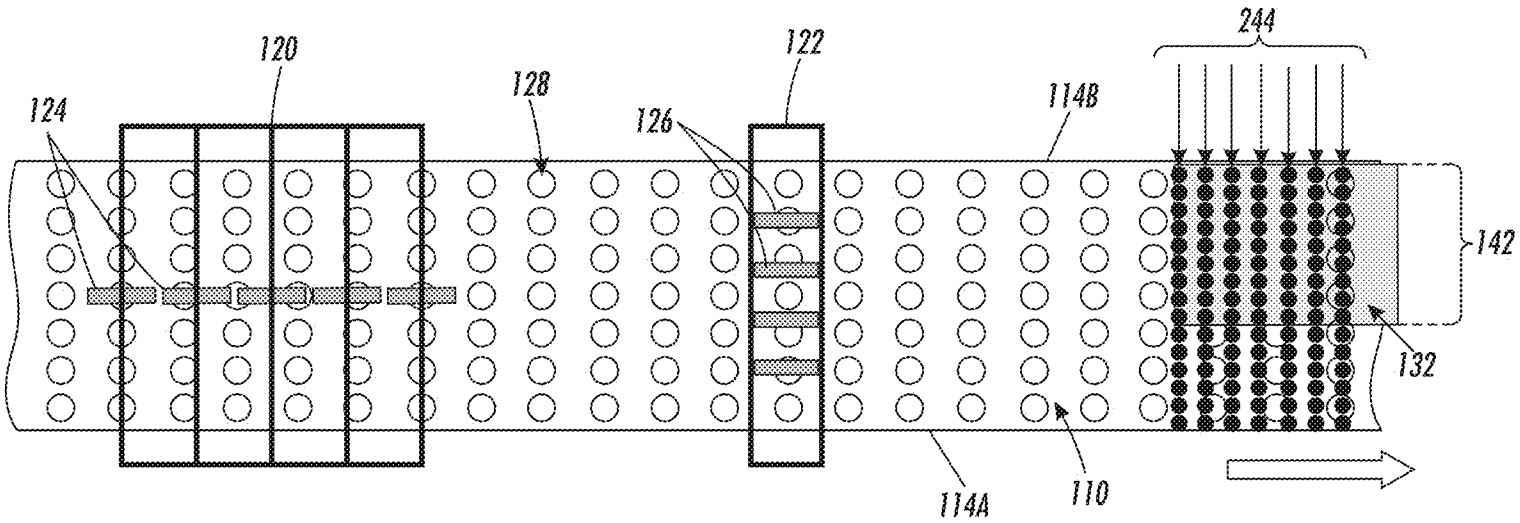

FIG. 4E illustrates that the controller 224 is adapted to control the inkjet printhead 242 to eject ink 246 from a first set of nozzles 140 to the first sacrificial sheet 130. FIG. 4F illustrates the sheet transport 110 moved additionally in the processing direction (relative to FIG. 4E) and shows that the controller 224 is similarly adapted to control the inkjet printhead 242 to eject ink 246 from a second set of nozzles 142 to the second sacrificial sheet 132.

As shown in FIGS. 4E-4F, the first set of nozzles 140 contains different nozzles 244 from the second set of nozzles 142. Here, nozzles 244 of the first set of nozzles 140 are relatively closest to the first edge 114A of the sheet transport 110, and nozzles 244 of the second set of nozzles 142 are relatively closest to the second edge 114B of the sheet transport 110. Also, as shown in FIGS. 4E-4F, the first set of nozzles 140 and second set of nozzles 142 can contain some overlapping nozzles while still containing different nozzles 244. In other words, some of the nozzles 244 toward the midline of the sheet transport 110 can be redundantly in both the first and second sets of nozzles 140, 142.

Additionally, the controller 224 can be adapted to control the inkjet printhead 242 to eject ink 246 to the first sacrificial sheet 130 and the second sacrificial sheet 132 from all nozzles 244 or only from nozzles 244 that have not ejected ink 246 for more than a non-use time limit. Therefore, while all the nozzles 244 within each set of nozzles 140, 142 can be jetted of ink (for example at specific page counts), in other situations only some of the nozzles 244 (specifically those that have not ejected ink for a time longer than the non-use time limit) may eject ink in the jetting operation.

As can be seen, the methods and devices herein use multiple sheets of media that are smaller than the width of the sheet transport 110 in combination to perform jetting onto media of all nozzles 244 along the maximum printing zone (full cross-processing width of the inkjet printheads). This performs jetting of the maximum print zone using any size sheets, thereby avoiding dedication of a print tray to elongated sheets that are not otherwise utilized for print job operations. This provide a user with the option to utilize smaller sheets to perform jetting of all nozzles within all printheads and allows the user to maintain only the actual size media that they regularly use for printing operations (print jobs) within the print trays.

Figure 5:
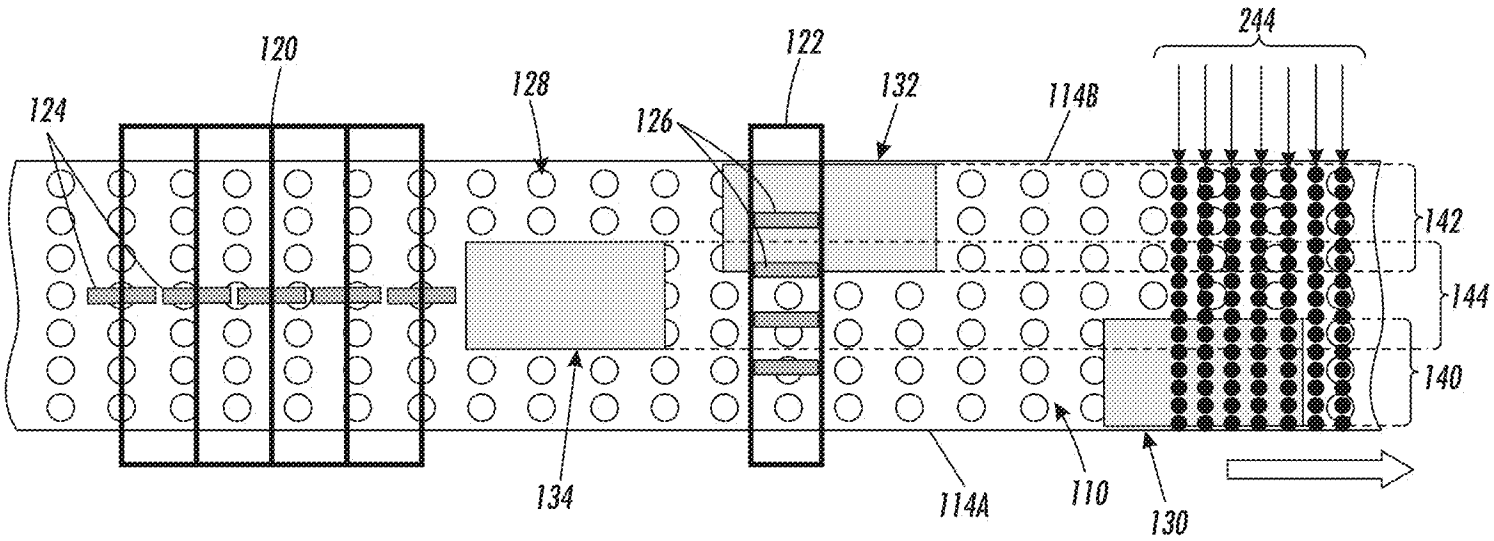

While the foregoing examples are presented using two sacrificial sheets, additional sacrificial sheets can be used in the same way. More specifically, as illustrated in FIG. 5, a third sacrificial sheet 134 (or more sacrificial sheets) can be used where even the combination of the first and second sacrificial sheets 130, 132 are not sufficiently wide to span the maximum printing zone. Thus, as shown in FIG. 5, when three sacrificial sheets are utilized, the controller 224 is further adapted to control the second sheet registration device to align the third sacrificial sheet 134 in a location along the sheet transport 110 that is between the first sacrificial sheet 130 and the second sacrificial sheet 132 (in this example along the midline of the sheet transport 110). Again, the third sacrificial sheet 134 immediately follows the first sacrificial sheet 130 and the second sacrificial sheet 132 (without any intervening sheets). Note, as also shown in FIG. 5, this creates three sets of nozzles 140, 142, and 144, which again operate as discussed above.

Figure 6:
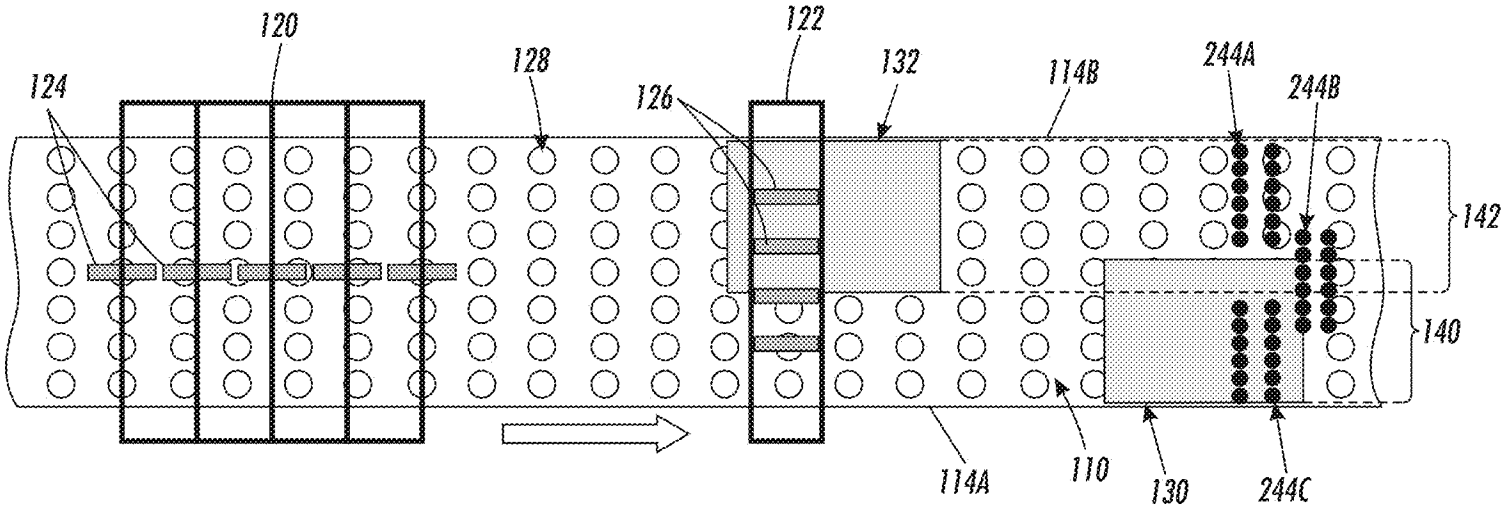

Because the printing engine 240 usually includes more than one printhead 242, multiple sets of nozzles 244A, 244B, and 244C are shown in FIG. 6, some of which are within the first set of nozzles 140, some of which are within the second set of nozzles 142 and some of which are within both sets of nozzles 140, 142. Note that in all examples herein, all nozzles 244 are positioned adjacent to an area of the sheet transport 110 that is between the first edge 114A and the second edge 114B. Further, the various sacrificial sheets 130, 132, 134, mentioned above are directed to a different location (e.g., a waste receptacle) from the location where print job sheets 136 are directed. Therefore, the sacrificial sheets are eventually discarded, while the print job sheets 136 are maintained as productive printer output to be provided to the user.

Figure 7:
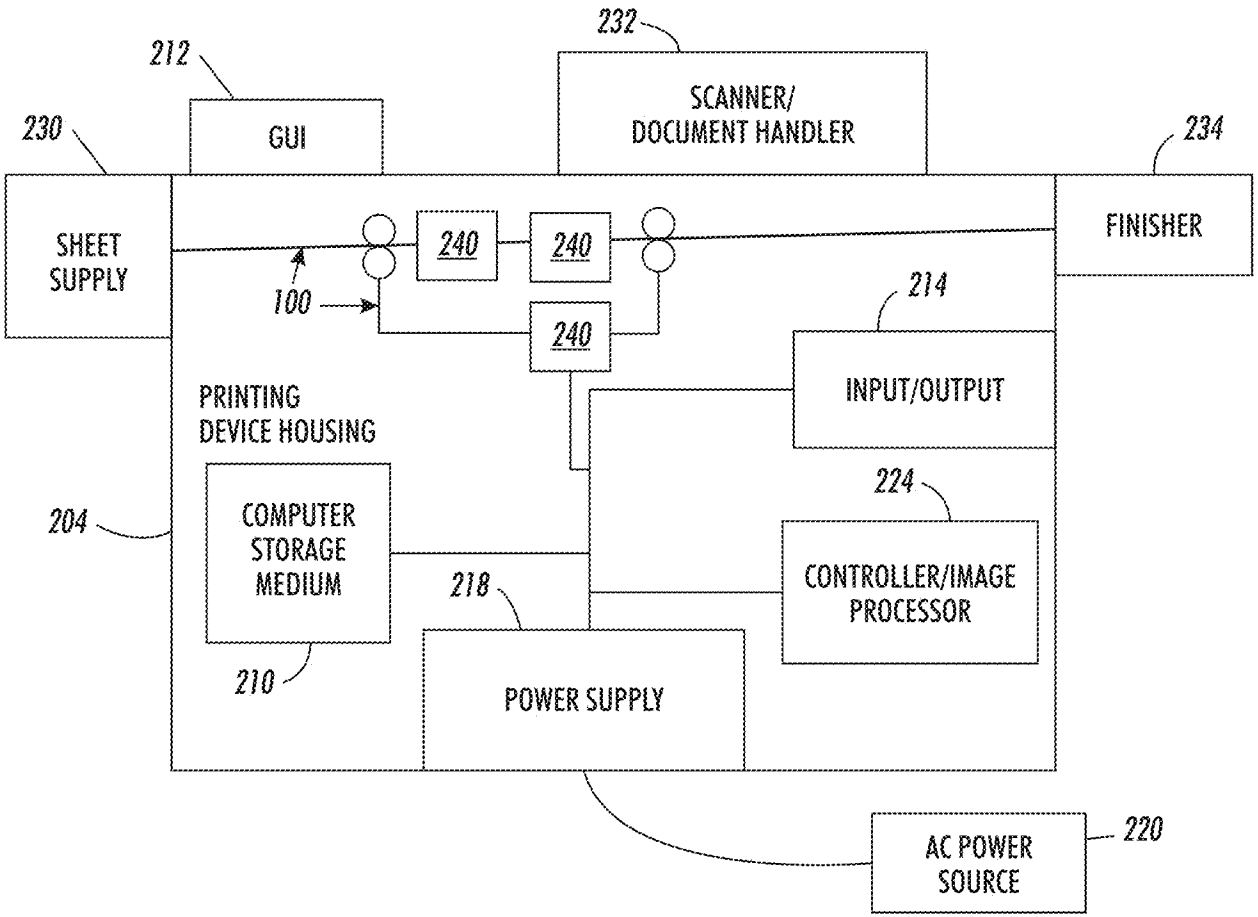
FIG. 7 is a conceptual diagram illustrating printing devices herein.

FIG. 7 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 7, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 240 that use marking material, and are operatively connected to a specialized image processor 224 (that is different from a general purpose computer because it is specialized for processing image data), a media path 100 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operates on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future.

Figure 8:
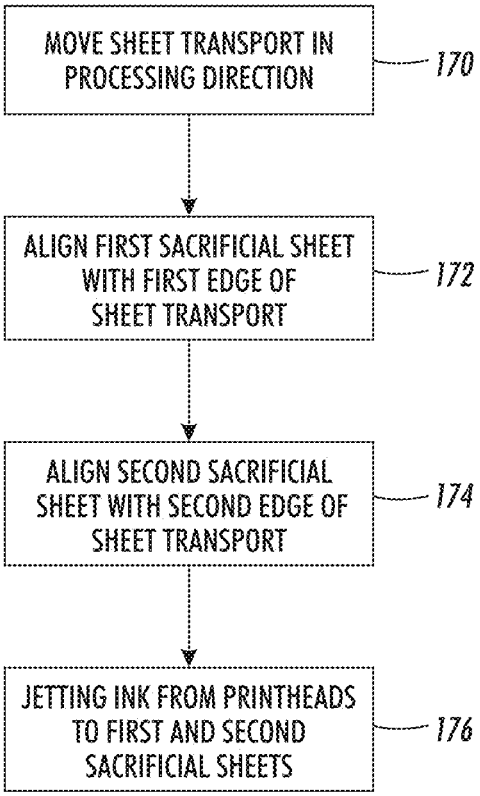
FIG. 8 is a flowchart illustrating methods herein.

FIG. 8 is a flowchart illustrating methods herein. More specifically, in item 170, these methods control the sheet transport to move the sheet transport in the processing direction to move sheets of media past the inkjet printhead. In item 172, these methods periodically control the sheet registration device to align the first sacrificial sheet with the first edge of the sheet transport. In item 174, these methods align the second sacrificial sheet with the second edge of the sheet transport. In the processes 172, 174 of controlling the sheet registration device, the first sacrificial sheet can immediately follow the first sacrificial sheet on the sheet transport. Additionally, the sheet registration device can be controlled to align additional sacrificial sheets in locations along the sheet transport that is between the cross-processing locations of the first sacrificial sheet and the second sacrificial sheet and that immediately follow the first sacrificial sheet and the second sacrificial sheet.

Also, in item 176, these methods jet the ink from the inkjet printheads to the first and the second sacrificial sheets by controlling the inkjet printhead to eject ink from a first set of nozzles to the first sacrificial sheet and eject ink from a second set of nozzles to the second sacrificial sheet. Again, the first set of nozzles contains at least some different nozzles from the second set of nozzles.

Additionally, the process of controlling the inkjet printhead to eject ink 176 can include controlling the inkjet printhead to eject ink from a third set of nozzles to the third sacrificial sheet, where the third set of nozzles contain different nozzles from the first set of nozzles and the second set of nozzles. Alternatively, the process of controlling the inkjet printhead to eject ink 176 can include controlling the inkjet printhead to eject ink from the first set of nozzles and the second set of nozzles to the third sacrificial sheet.

The process of controlling the inkjet printhead to eject ink 176 can control the inkjet printhead to eject ink to the first sacrificial sheet and the second sacrificial sheet only from nozzles that have not ejected ink for more than a non-used time limit.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A device comprising:

an inkjet printhead;

a sheet transport positioned to move sheets of media past the inkjet printhead;

a sheet registration device positioned to align the sheets of media; and a controller electrically connected to the inkjet printhead and the sheet registration device, wherein the controller is adapted to periodically control the sheet registration device to align a first sacrificial sheet with a first edge of the sheet transport and align a second sacrificial sheet with a second edge of the sheet transport and that is opposite the first edge, wherein the controller is adapted to control the inkjet printhead to eject ink from a first set of nozzles to the first sacrificial sheet and eject ink from a second set of nozzles to the second sacrificial sheet, and wherein the first set of nozzles contains different nozzles from the second set of nozzles.

2. The device according to claim 1, wherein ones of the first set of nozzles are relatively closest to the first edge of the sheet transport, and wherein ones of the second set of nozzles are relatively closest to the second edge of the sheet transport.

3. The device according to claim 1, wherein the inkjet printhead comprises a first printhead and a second printhead, wherein the first set of nozzles are within the first printhead and the second set of nozzles are within the second printhead.

4. The device according to claim 1, wherein the controller is adapted to control the inkjet printhead to eject ink to the first sacrificial sheet and the second sacrificial sheet only from nozzles that have not ejected ink for more than a non-used time limit.

5. The device according to claim 1, wherein the inkjet printhead is located adjacent to the sheet transport in a position such that all nozzles of the inkjet printhead are positioned adjacent to an area of the sheet transport that is between the first edge and the second edge of the sheet transport.

6. The device according to claim 1, wherein the first sacrificial sheet immediately follows the first sacrificial sheet on the sheet transport.

7. The device according to claim 1, wherein the controller is adapted to control the sheet registration device to align a third sacrificial sheet in a location along the sheet transport that is between the first sacrificial sheet and the second sacrificial sheet and that immediately follows the first sacrificial sheet and the second sacrificial sheet.

8. A device comprising:

an inkjet printhead;

a sheet transport positioned to move sheets of media past the inkjet printhead;

a second sheet registration device adapted to align the sheets of media relative to the inkjet printhead;

a first sheet registration device adapted to align the sheets of media relative to edges of the sheet transport; and a controller electrically connected to the inkjet printhead, and the first sheet registration device, wherein the controller is adapted to periodically activate the first sheet registration device to align an edge of a first sacrificial sheet with a first edge of the sheet transport and align an edge of a second sacrificial sheet with a second edge of the sheet transport and that is opposite the first edge, wherein the controller is adapted to control the inkjet printhead to eject ink from a first set of nozzles to the first sacrificial sheet and eject ink from a second set of nozzles to the second sacrificial sheet, and wherein the first set of nozzles contains different nozzles from the second set of nozzles.

9. The device according to claim 8, wherein ones of the first set of nozzles are relatively closest to the first edge of the sheet transport, and wherein ones of the second set of nozzles are relatively closest to the second edge of the sheet transport.

10. The device according to claim 8, wherein the inkjet printhead comprises a first printhead and a second printhead, wherein the first set of nozzles are within the first printhead and the second set of nozzles are within the second printhead.

11. The device according to claim 8, wherein the controller is adapted to control the inkjet printhead to eject ink to the first sacrificial sheet and the second sacrificial sheet only from nozzles that have not ejected ink for more than a non-used time limit.

12. The device according to claim 8, wherein the inkjet printhead is located adjacent to the sheet transport in a position such that all nozzles of the inkjet printhead are positioned adjacent to an area of the sheet transport that is between the first edge and the second edge of the sheet transport.

13. The device according to claim 8, wherein the first sacrificial sheet immediately follows the first sacrificial sheet on the sheet transport.

14. The device according to claim 8, wherein the controller is adapted to control the second sheet registration device to align a third sacrificial sheet in a location along the sheet transport that is between the first sacrificial sheet and the second sacrificial sheet and that immediately follows the first sacrificial sheet and the second sacrificial sheet.

15. A method comprising:

controlling a sheet transport to move sheets of media past an inkjet printhead;

periodically controlling a sheet registration device to align a first sacrificial sheet with a first edge of the sheet transport and align a second sacrificial sheet with a second edge of the sheet transport and that is opposite the first edge; and controlling the inkjet printhead to eject ink from a first set of nozzles to the first sacrificial sheet and eject ink from a second set of nozzles to the second sacrificial sheet, wherein the first set of nozzles contains different nozzles from the second set of nozzles.

16. The method according to claim 15, wherein the controlling the inkjet printhead to eject ink controls the inkjet printhead to eject ink to the first sacrificial sheet and the second sacrificial sheet only from nozzles that have not ejected ink for more than a non-used time limit.

17. The method according to claim 15, wherein, during the controlling the sheet registration device, the first sacrificial sheet immediately follows the first sacrificial sheet on the sheet transport.

18. The method according to claim 15, further comprising controlling the sheet registration device to align a third sacrificial sheet in a location along the sheet transport that is between the first sacrificial sheet and the second sacrificial sheet and that immediately follows the first sacrificial sheet and the second sacrificial sheet.

19. The method according to claim 15, wherein the controlling the inkjet printhead to eject ink includes controlling the inkjet printhead to eject ink from a third set of nozzles to the third sacrificial sheet, and wherein the third set of nozzles contains different nozzles from the first set of nozzles and the second set of nozzles.

20. The method according to claim 19, wherein the controlling the inkjet printhead to eject ink includes controlling the inkjet printhead to eject ink from the first set of nozzles and the second set of nozzles to the third sacrificial sheet.

* * * * *